US012448194B2

(12) United States Patent
Iriti

(10) Patent No.: US 12,448,194 B2
(45) Date of Patent: Oct. 21, 2025

(54) PACK OF TISSUE PAPER ROLLS AND METHOD

(71) Applicant: SOFIDEL S.P.A., Porcari (IT)

(72) Inventor: Marco Iriti, Porcari (IT)

(73) Assignee: SOFIDEL S.P.A., Porcari (IT)

( * ) Notice: Subject to any disclaimer, the term of this patent is extended or adjusted under 35 U.S.C. 154(b) by 0 days.

(21) Appl. No.: 18/341,952

(22) Filed: Jun. 27, 2023

(65) Prior Publication Data

US 2023/0415970 A1 Dec. 28, 2023

(30) Foreign Application Priority Data

Jun. 28, 2022 (IT) ..... 102022000013645

(51) Int. Cl.

| | |
|---|---|
| ***B65D 77/00*** | (2006.01) |
| ***B65B 11/02*** | (2006.01) |
| ***B65D 75/56*** | (2006.01) |
| ***B65D 85/67*** | (2006.01) |

(52) U.S. Cl.

CPC ..... *B65D 77/003* (2013.01); *B65B 11/02* (2013.01); *B65D 75/563* (2013.01); *B65D 85/67* (2013.01)

(58) Field of Classification Search

CPC ..... B65D 77/003; B65D 85/66; B65D 85/67; B65D 85/672; B65D 85/676; B65B 11/02

USPC ..... 206/391, 389, 390

See application file for complete search history.

(56) References Cited

U.S. PATENT DOCUMENTS 4,259,092 A * 3/1981 Matsuo ..... C01B 32/382 428/184
4,444,311 A * 4/1984 Rias ..... B65D 71/0088 206/443
4,535,587 A 8/1985 Rias
4,765,474 A * 8/1988 James ..... B65D 75/566 206/391
4,886,167 A * 12/1989 Dearwester ..... B65D 85/672 206/83.5
7,311,199 B2 * 12/2007 Vantilt ..... B65B 11/585 53/436
9,821,923 B2 * 11/2017 Moore ..... B65B 27/125
11,697,538 B2 * 7/2023 Anklam ..... B32B 23/08 206/391
11,724,865 B2 * 8/2023 Tomioka ..... B65D 85/672 206/391
2007/0084741 A1 * 4/2007 Dall'Omo ..... B65D 75/52 206/391
2008/0078685 A1 * 4/2008 Patterson ..... B65D 85/07 206/391
2012/0205272 A1 * 8/2012 Heilman ..... B65B 25/146 206/391
2017/0057733 A1 * 3/2017 Wentz ..... B65D 85/62

FOREIGN PATENT DOCUMENTS

WO 2018069781 A1 4/2018
WO 2019152000 A1 8/2019

* cited by examiner

*Primary Examiner* — Rafael A Ortiz

(74) *Attorney, Agent, or Firm* — McGlew and Tuttle, P.C.

(57) ABSTRACT

The pack of tissue paper rolls comprises a set of rolls having at least one layer of rolls and having a first base, a second base and a side surface extending from the first base to the second base of the set of rolls. A wrapping sheet completely envelops the set of rolls and a panel, with greater stiffness than the wrapping sheet, surrounds the side surface of the set of rolls and is arranged inside the wrapping sheet, between it and the rolls.

20 Claims, 3 Drawing Sheets

1
3
5
R
5A
5B
3B
3A
A
7
9

PACK OF TISSUE PAPER ROLLS AND METHOD

TECHNICAL FIELD

The present invention relates to the field of tissue paper rolls, for example rolls of toilet paper or kitchen towels.

Background Art

Tissue paper is frequently made into rolls, such as toilet paper, kitchen towels and the like. Rolls of tissue paper are usually packaged in sets of rolls containing a geometrically ordered arrangement of rolls, wrapped in a wrapping sheet. The wrapping sheet is normally a sheet of plastic film, for example a polymer film. Recently, to reduce the consumption of polymeric products and the consequent environmental impact of these materials, so-called bioplastic films, i.e. biodegradable films, have also been adopted. In some cases, the wrapping sheet is a sheet of cellulosic material (paper).

There are different types of packs that have been developed to meet various needs. For example, WO2019/152000 discloses a composite pack, in which tissue paper rolls of different axial dimensions are contained, for example toilet paper rolls and kitchen paper rolls. To obtain a regular shaped pack, two sets of rolls of different sizes are separated by a folded panel, which also forms a cavity in which folded, rather than rolled-up, tissue products can be housed.

U.S. Pat. No. 4,886,167 discloses a pack of tissue paper rolls which are pressed and flattened to reduce the bulk thereof, taking on a parallelepiped rather than a cylindrical shape. The rolls deformed in this way are contained in a wrapping sheet, inside which the flattened rolls are wrapped by a band which embraces two opposite flat bases of the pack, defined by the flat surfaces of the rolls, i.e. by the surfaces perpendicular to the winding axes of the rolls.

U.S. Pat. No. 9,821,923 discloses a package and a method of packaging tissue paper rolls. The package is obtained by joining together a plurality of packs of rolls. Each pack contains a set of rolls packed in a heat-shrinkable polymer film. The individual packs are joined together by a band external to the heat-shrinkable film. The band has a width smaller than the height of the final pack and surrounds the side surface of the set of rolls. The band does not have a product protection function, but serves to bind and hold together several multiple packs, each wrapped in its own heat-shrinkable polymeric film.

The usual pack of tissue paper rolls are not suitable for single shipping, because the pack can be easily damaged with consequent deterioration of the tissue product contained therein. This is a limit to the purchase of these products through the usual e-commerce channels.

There is therefore a need to provide a pack which overcomes or reduces the above-mentioned drawbacks of traditional packs.

SUMMARY

In embodiments disclosed herein, a pack of tissue paper rolls is provided, comprising a set of rolls having at least one layer of rolls and having a first base, a second base and a side surface extending from the first base to the second base of the set of rolls. A wrapping sheet completely envelops the set of rolls and a panel, with greater stiffness than the wrapping sheet, surrounds the side surface of the set of rolls and is arranged inside the wrapping sheet, between the wrapping sheet and the rolls. The panel may consist of a strip of cardboard, such as single face corrugated board, wrapped around the set of rolls.

In practical embodiments, the panel completely envelops the side surface of the set of rolls, i.e. completely surrounds the set of rolls around the side surface thereof.

In practice, the first base and the second base of the pack are flat and the flat faces of the rolls face them. Cylindrical side surfaces of the rolls face the side surface of the pack and the panel envelops the side surfaces of the rolls facing the side surface of the pack. The flat faces of a roll consist in practice of the roll surfaces orthogonal to the roll axis.

More specifically, in embodiments, each roll comprises a first flat face and a second flat face, as well as a cylindrical side surface extending from the first flat face to the second flat face. The rolls are positioned in the pack in such a way that: the first flat faces of a plurality of rolls lie on a first flat surface which forms the first flat base of the pack. The second flat faces of a plurality of rolls are arranged on a second flat surface which forms the second flat base of the pack. In this way, the panel laterally envelops a laterally exposed portion of the cylindrical surfaces of rolls contained in the pack.

The panel laterally protects the rolls from impacts and external pressure, preserving the integrity of the rolls.

Advantageously, the side panel has a dimension equal to or greater than the distance between the first base and the second base of the pack. In this way, the side panel also protects the edges of the pack and possibly the flat faces of the rolls exposed on the first base and on the second base of the pack.

Further advantageous features and embodiments of the pack are described below and defined in the appended claims.

According to a further aspect, a method of packaging rolls of tissue paper is described herein. The method comprises the following steps:

- forming a set of rolls comprising at least one layer of rolls placed side by side; wherein each roll comprises a first flat face, a second flat face and a cylindrical side surface extending from the first flat face to the second flat face; and wherein the rolls are arranged in the set of rolls so that the set of rolls has: a first base formed by first flat faces of at least some of said rolls, a second base formed by second flat faces of at least some of said rolls, and a side surface extending from the first base to the second base, the side surface being formed by cylindrical side surfaces of rolls of the set of rolls;
- wrapping a protection panel around the side surface of the set of rolls;
- wrapping the set of rolls and the protection panel with a wrapping sheet which wraps the first base, the second base, and the side surface of the set of rolls, with the wrapped protection panel sandwiched between the side surface of the set of rolls and the wrapping sheet; wherein the protection panel has a greater stiffness than the wrapping sheet.

BRIEF DESCRIPTION OF THE DRAWINGS

The invention will be better understood by following the description and the accompanying drawings, which illustrate an exemplifying and non-limiting embodiment of the invention. More particularly, the drawings show.

DETAILED DESCRIPTION

Figures 1, 1A, 2:
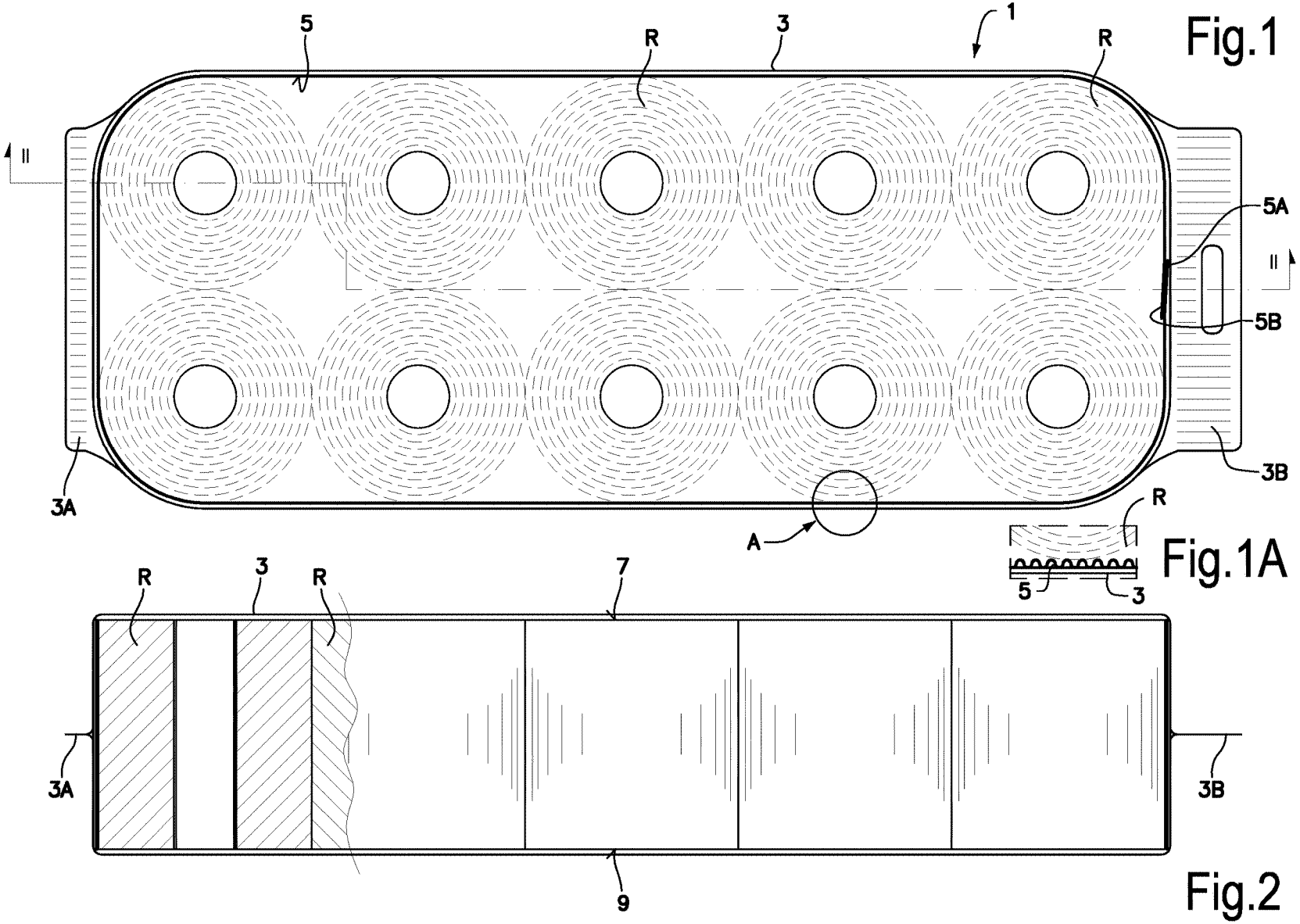
FIG. 1 is a plan view of a first pack according to the invention.
FIG. 1A an enlargement of the detail indicated with A in FIG. 1.
FIG. 2 a section according to II-II of FIG. 1.

A first embodiment of a pack according to the present invention is illustrated in FIGS. 1 and 2. The pack is generically indicated with reference numeral 1 and contains, in this case, a set of rolls R arranged according to a single layer of two rows of five rolls each.

Each roll comprises a first flat face and a second flat face, as well as a cylindrical side surface extending from the first flat face to the second flat face.

The pack is wrapped in a wrapping sheet 3. In the embodiment of FIGS. 1 and 2, the wrapping sheet 3 forms an envelope with a bottom 3A closed by welding and an opposite handle 3B formed by welding two edges of the wrapping sheet.

The wrapping sheet 3 can be a sheet of plastic film, for example bioplastic or a polymer. In other embodiments, the wrapping sheet 3 can be a sheet of paper. In this case, the welds can be replaced by a gluing.

To give greater mechanical strength to the pack, a panel 5 with greater stiffness than the stiffness of the wrapping sheet 3 is arranged inside the envelope formed by the wrapping sheet 3. The panel 5 can be a cardboard panel, for example single face or double face corrugated board. In the enlargement of FIG. 1A, the panel 5 is represented in the form of a strip of single face corrugated board comprising a liner and a corrugated sheet glued together.

The panel 5 can be in the form of a strip which laterally wraps the set of rolls R. More particularly, in the embodiment illustrated in FIGS. 1, 1A and 2, the panel 5 surrounds the side surfaces of the set of rolls R, leaving the two upper and lower flat bases (indicated with 7 and 9 in FIG. 2) of pack 1 free.

Two ends 5A and 5B of the panel 5 wrapped around the set of rolls R are shown in FIG. 1. The two ends 5A, 5B can be slightly overlapped and can possibly be joined together, for example by gluing or sewing. However, this is not necessary. In fact, once the wrapping sheet 3 has been closed forming the external envelope of the pack 1, the panel 5 remains held in its side wrapping position of the set of rolls R, without the possibility of displacement.

The panel 5 protects the side surface portions (i.e. the portions of cylindrical surfaces) of the packaged rolls R, avoiding damage during transport, also allowing the shipment of single packs without risk of damage, or with a reduced risk of damage, to the product.

Figure 3:
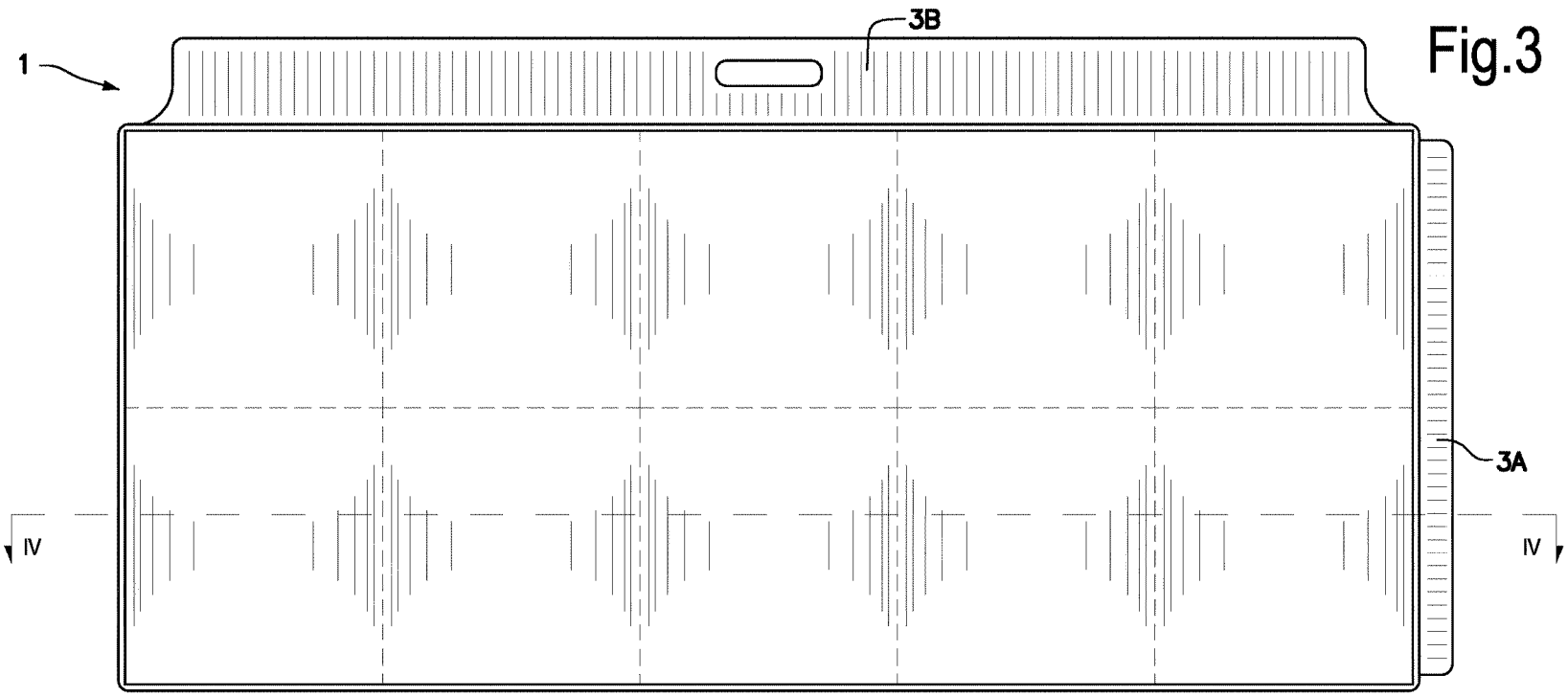
FIG. 3 is a side view of a second pack according to the invention.
Figure 4:
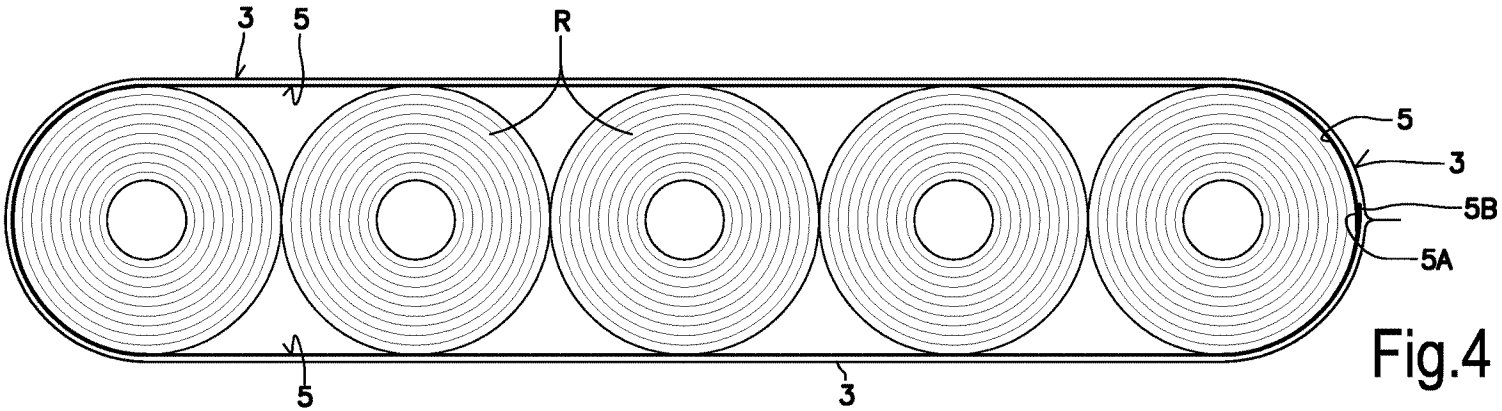
FIG. 4 is a section according to IV-IV of FIG. 3.

The shape of the pack of FIGS. 1 and 2 is merely exemplary. In fact, the concept can be applied to a plurality of different packs of tissue paper rolls. By way of example, FIGS. 3 and 4 show a different pack, still indicated with reference numeral 1, wherein the rolls R are arranged in a plurality of stacks, in the illustrated example five stacks, each containing a plurality of superimposed rolls in a coaxial position, in the illustrated example two rolls per stack. The pack 1 also comprises a wrapping sheet 3, which in this embodiment is shaped like an envelope with a handle 3B and a sealed edge 3A. While in the embodiment of FIGS. 1, 1A and 2, the panel 5 has a height approximately equal to, or slightly higher than, the axial dimension of the rolls R, in FIGS. 3 and 4, since the rolls are superimposed two by two, the panel 5 has a height approximately equal to, or slightly greater than, twice the height of the individual rolls R.

As in the embodiment of FIGS. 1, 1A, 2, also in FIGS. 2 and 3 the panel 5 can be a cardboard panel, single face corrugated board, single wave double face corrugated board or the like. Preferably, the panel 5 is a single face corrugated board panel (see FIG. 1A) as it is more cost-effective and in any case of sufficient consistency to protect the rolls. The panel 5 laterally surrounds the stacks of rolls R, enveloping the cylindrical side surfaces of the rolls which are thus protected from mechanical stresses which can cause damage. The ends 5A, 5B of the panel 5 are preferably superimposed and can be joined together or held in position by the external wrapping sheet 3, as mentioned with reference to the embodiment of FIGS. 1, 1A, 2.

Figure 5:
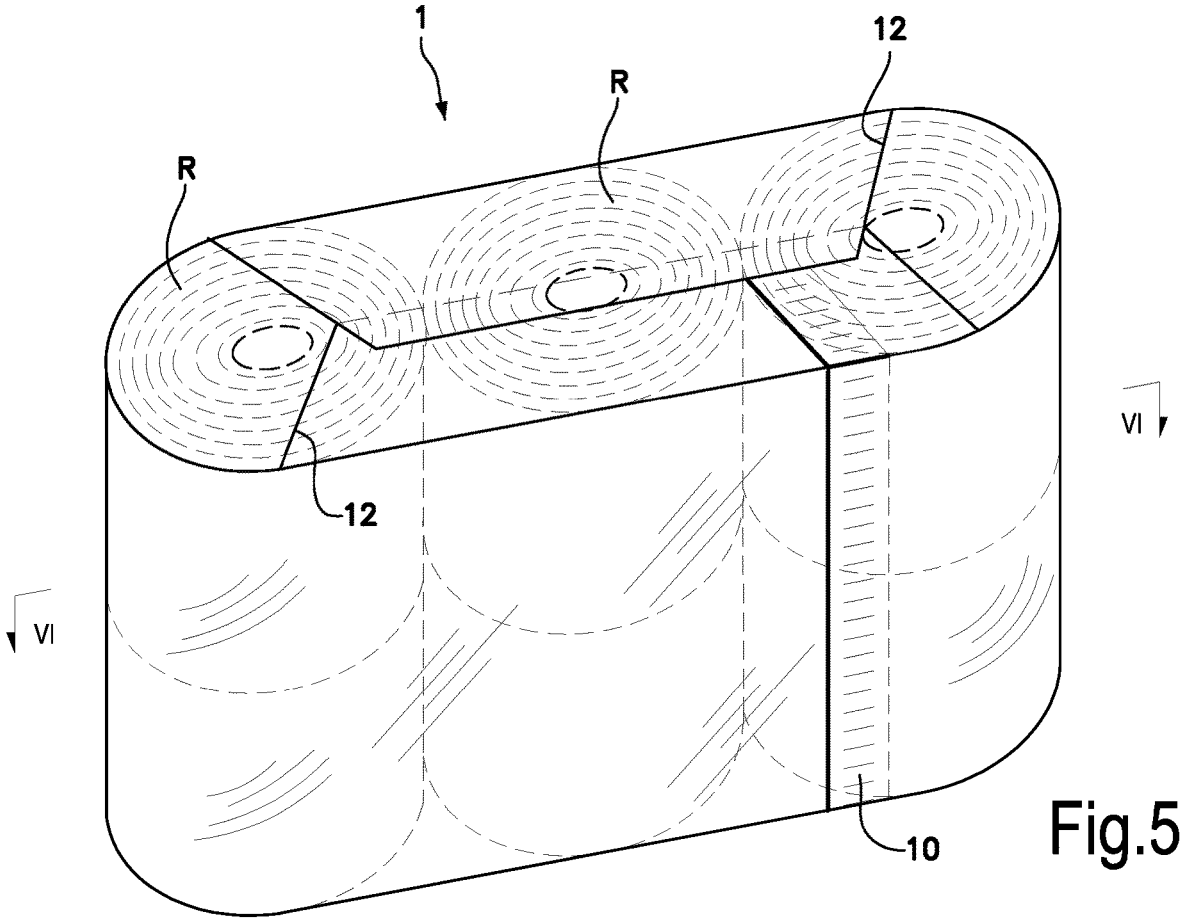
FIG. 5 a view of a third pack according to the invention.
Figure 6:
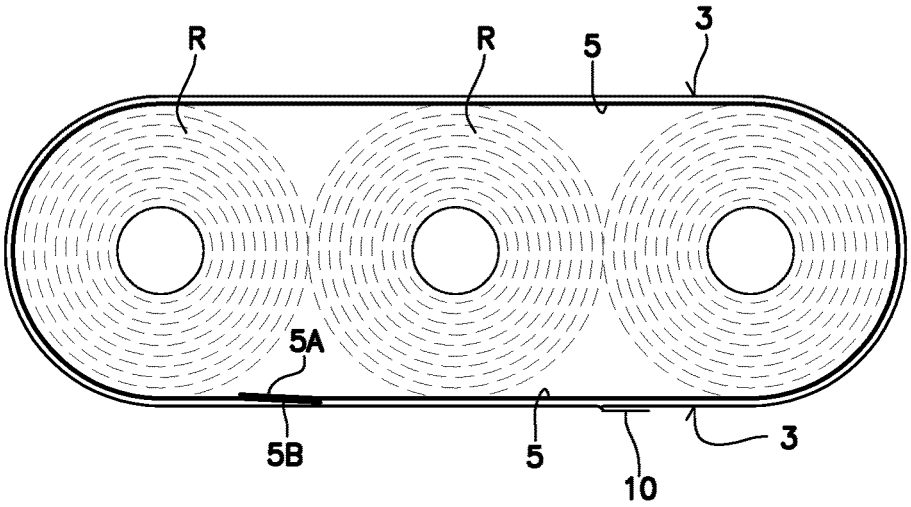
FIG. 6 a section according to VI-VI of FIG. 5.

While in the embodiments of FIGS. 1 to 4, the packs are made in the form of shaped envelopes with a handle, in other embodiments the pack can be obtained by folding and welding or gluing a sheet, without forming handles. FIGS. 5 and 6 show a pack of this type, still indicated with reference numeral 1. In the illustrated example, for illustrative and non-limiting purposes, the pack comprises four rolls stacked two by two. The number and arrangement of rolls R may differ from the one shown.

The wrapping sheet 3 has folded and welded or glued flaps on the two flat bases of a set of rolls R. The flaps are indicated with reference numeral 12 in FIG. 5. Along the side surface there is a sealing 10 of two edges of the wrapping sheet. A panel 5 of greater stiffness than the wrapping sheet 3 is wrapped around the side surfaces of the pack, consisting of the exposed side surfaces of the rolls R. The panel 5, for example of corrugated board, preferably single face corrugated board with a smooth liner and a corrugated sheet, has two superimposed edges 5A, 5B joined together or simply held by the outer wrapping sheet 3. The height of the panel 5 can be equal to or slightly higher than the height of the stacks of rolls R (in the example two superimposed rolls).

In the examples described above, some possible configurations of the sets of rolls are shown. It should be understood that these are only some of the possible arrangements and that sets with a larger or smaller number of rolls arranged on one or more stacked layers can be provided.

In general, the pack can be obtained as follows. In a first step of the packaging process, a set of rolls is formed by forming at least one layer of rolls arranged side by side and coplanar, i.e. arranged with the flat faces on opposite flat surfaces parallel to each other. The set can include multiple stacked layers. The external flat surfaces of the set of rolls thus sorted form the two bases of the set of rolls and of the pack. The exposed cylindrical side surfaces of the set of rolls form the side surface of the set of rolls.

The packaging process also envisages wrapping a protection panel around the side surface of the set of rolls and wrapping the set of rolls and the protection panel with a wrapping sheet which wraps around the first base, the second base, and the side surface of the set of rolls with the wrapped protection panel sandwiched between the side surface of the set of rolls and the wrapping sheet.

It is understood that the packs illustrated above are merely by way of example and that the invention is not limited to the embodiments illustrated, but its scope is defined by the following claims.

What is claimed is:

1. A pack of tissue paper rolls, comprising:

a set of rolls comprising at least one layer of rolls, the set of rolls having a first base, a second base and a side surface extending from the first base to the second base of the set of rolls; wherein each roll has a first flat face, a second flat face and a cylindrical side surface;

a wrapping sheet which completely wraps around the first base, the second base and the side surface of the set of rolls; and a panel with greater stiffness than the wrapping sheet, which completely surrounds said side surface and leaves the first base and second base of the pack free; wherein the panel is positioned between the set of rolls and the wrapping sheet; wherein the panel is retained in position around the side surface by the wrapping sheet once the wrapping sheet has been closed forming an external envelope of the pack; wherein the panel has a height approximately equal to or greater than the distance between the first base and the second base of the set of rolls.

2. The pack of claim 1, wherein the panel completely envelops the side surface of the set of rolls.

3. The pack of claim 1, wherein the first base is flat and the second base is flat; wherein the flat faces of said rolls face onto them; wherein the cylindrical side surfaces of the rolls face the side surface of the pack; and wherein the panel envelops the side surfaces of the rolls facing the side surface of the pack.

4. The pack of claim 1, wherein the rolls are arranged in the pack in such a way that the first flat faces of at least some of the rolls contained in the pack are arranged on the first base and the second flat faces of at least some of the rolls contained in the pack are arranged on the second base, the first base and the second base of the pack being flat; and wherein the cylindrical side surfaces of the rolls are arranged along the side surface of the pack.

5. The pack of claim 1, wherein the panel is formed from a cardboard sheet.

6. The pack of claim 1, wherein the panel is formed from a corrugated board sheet.

7. The pack of claim 6, wherein the panel is formed from a single face corrugated board sheet, consisting of a liner of flat paper and a sheet of corrugated paper glued together.

8. The pack of claim 1, wherein the wrapping sheet is selected from the group comprising: a sheet of polymeric film; a sheet of bioplastic; a sheet of paper.

9. The pack of claim 1, wherein the wrapping sheet is closed by welding or gluing.

10. The pack claim 1, wherein the wrapping sheet forms a handle.

11. A method of packaging rolls of tissue paper, the method comprising the following steps:

forming a set of rolls comprising at least one layer of rolls placed side by side; wherein each roll comprises a first flat face, a second flat face and a cylindrical side surface extending from the first flat face to the second flat face; and wherein the rolls are arranged in the set of rolls so that the set of rolls has: a first base formed by first flat faces of at least some of said rolls, a second base formed by second flat faces of at least some of said rolls, and a side surface extending from the first base to the second base, the side surface being formed by cylindrical side surfaces of rolls of the set of rolls;

wrapping a protection panel around the entire side surface of the set of rolls, leaving the first base and the second base free of said protection panel;

wrapping the set of rolls and the protection panel with a wrapping sheet which wraps the first base, the second base, and the side surface of the set of rolls with the wrapped protection panel sandwiched between the side surface of the set of rolls and the wrapping sheet, wherein the panel is retained in position around the side surface by the wrapping sheet once the wrapping sheet has been closed forming an external envelope of the pack; wherein the protection panel has a greater stiffness than the wrapping sheet.

12. The method of claim 11, wherein the wrapping sheet is closed by gluing or welding.

13. The method of claim 11, wherein the wrapping sheet is selected from the group comprising: a sheet of polymeric film; a sheet of bioplastic; a sheet of paper.

14. The method of claim 11, wherein the protection panel has a height equal to or greater than the distance between the first base and the second base of the set of rolls.

15. The method of claim 11, wherein the protection panel is formed from a sheet of cardboard, preferably a sheet of corrugated board, preferably a sheet of single face corrugated board, consisting of a liner of smooth paper and a sheet of corrugated paper glued together.

16. A pack of tissue paper rolls, comprising:

a plurality of rolls, each of the plurality of rolls being arranged adjacent another one of the plurality of rolls to form at least one layer of rolls, the at least one layer of rolls comprising a first base, a second base and a side surface extending from the first base to the second base, each of the plurality of rolls comprising a first flat face, a second flat face and a cylindrical side surface;

a wrapping sheet completely extending about the first base, the second base and the side surface of the at least layer of rolls, the wrapping sheet having a wrapping sheet stiffness; and a panel comprising a panel stiffness, the panel stiffness being greater than the wrapping sheet stiffness, the panel completely surrounding the side surface of the at least one layer of rolls, the first base and the second base of the at least one layer of rolls being free of the panel, the panel being located between the at least one layer of rolls and the wrapping sheet, wherein the panel is fixed in position around the side surface via the wrapping sheet, the panel having a height equal to or greater than a distance between the first base and the second base of the at least one layer of rolls.

17. The pack of claim 16, wherein the panel only extends about the side surface of the at least one layer of rolls.

18. The pack of claim 16, wherein the first base is flat and the second base is flat, wherein the flat faces of said rolls face onto them, wherein the cylindrical side surfaces of the rolls face the side surface of the pack, and wherein the panel envelops the side surfaces of the rolls facing the side surface of the pack.

19. The pack of claim 16, wherein the rolls are arranged such that the first flat faces of at least one of the rolls is arranged on the first base and the second flat face of at least one of the rolls is arranged on the second base, the first base and the second base being flat, wherein the cylindrical side surfaces of the rolls are arranged along the side surface of the at least one layer of rolls.

20. The pack of claim 16, wherein the panel is formed from a cardboard sheet.

* * * * *